United States Patent [19]

Maillefer

[11] Patent Number: 4,718,817

[45] Date of Patent: Jan. 12, 1988

[54] DRUM LOADING AND UNLOADING APPARATUS

[75] Inventor: Charles E. Maillefer, Buchillon, Switzerland

[73] Assignee: Maillefer S.A., Switzerland

[21] Appl. No.: 893,260

[22] Filed: Aug. 5, 1986

[30] Foreign Application Priority Data

Aug. 28, 1985 [CH] Switzerland ..... 3692/85

[51] Int. Cl.[4] ..... B65H 75/00

[52] U.S. Cl. ..... 414/744 R; 414/222; 414/911; 242/54 R; 242/58.6; 242/79

[58] Field of Search ..... 414/744 R, 744 A, 222, 414/225, 749–751, 910, 911; 242/54 R, 58.6, 79

[56] References Cited

U.S. PATENT DOCUMENTS

| | | | |
|---|---|---|---|
| 1,869,545 | 8/1932 | Crafts | 242/58.6 |
| 2,392,409 | 1/1946 | Ray | 414/749 X |
| 2,499,562 | 3/1950 | Behrens | 242/58.6 |
| 2,991,953 | 7/1961 | Moser et al. | 242/58.6 X |
| 3,687,391 | 8/1972 | Bournez | 242/79 |
| 3,948,462 | 4/1976 | Maillefer | 242/158 R |
| 4,209,140 | 6/1980 | Seibert | 414/911 X |
| 4,558,830 | 12/1985 | Larsson | 414/911 X |
| 4,588,344 | 5/1986 | Burke et al. | 414/225 |

FOREIGN PATENT DOCUMENTS 508677 9/1930 Fed. Rep. of Germany .

*Primary Examiner*—Spar Robert J.
*Assistant Examiner*—Jay I. Alexander
*Attorney, Agent, or Firm*—Parkhurst & Oliff

[57] ABSTRACT

The drums to be loaded or unloaded are placed on a carriage borne by rollers and comprising telescopic arms. The carriage is guided along an arcuate path by a rigid arm and a pivot pin situated at the end of a bar supported by a base. A motor is provided on the carriage to drive the carriage in the arcuate path.

7 Claims, 5 Drawing Figures

FIG. 4
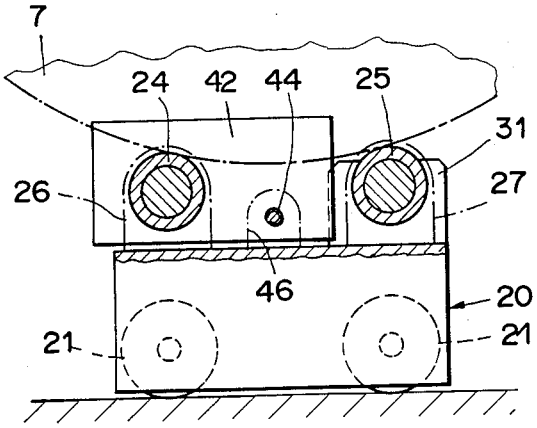
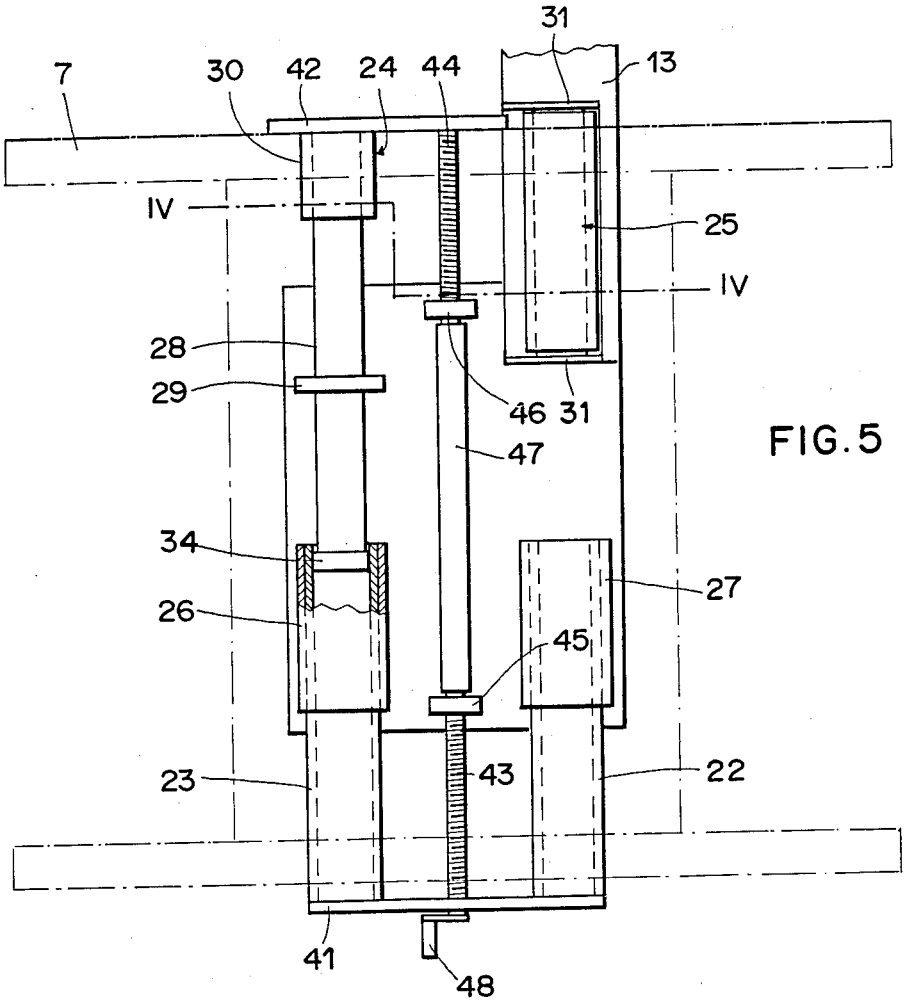
FIG. 5

DRUM LOADING AND UNLOADING APPARATUS

BACKGROUND AND SUMMARY OF THE INVENTION

This invention relates to winding operations, and more particularly to apparatus for loading or unloading a drum on a winding machine.

Winding and unwinding machines of the gantry type, capable of taking large-size drums, are described in Swiss Pat. No. 576,392, among others. Such large drums hold electric cable, for example, and because of their size and weight, they are difficult to load and unload. As a matter of fact, these drums may weigh several tons, and in some instances their flanges are several meters in diameter. In most cases, the drum supports are movable vertically on the uprights of the gantry, so that the trunnions can be brought to the level of the axis of the drum when it has been placed between the uprights, and the drum can thus be seized and lifted into winding or unwinding position. However, the fitting of these trunnions into the axial recesses in the flanges of the drums may be hampered if the axis of the drum is not perfectly aligned with the axis of the trunnions.

It has already been envisaged to equip winding machines of this type with special devices to facilitate the placing of the drums, which in most cases are brought up by means of a fork lift having prongs long enough so that the two flanges of the drum are balanced thereon. German Pat. No. 508,677, for example, provides for fixed, parallel support bars which automatically center the drums before they are lifted to be gripped by the trunnions of the drum supports.

Yet this prior art device does not solve all the problems which arise, and in particular, it requires excavation in the floor of the premises where the winding machine is installed, which is a drawback as regards the general layout of a cable-manufacturing plant.

It is therefore an object of this invention to provide improved drum loading and unloading apparatus which represents a simpler and more practical solution to the above-mentioned problems than prior art apparatus.

To this end, in the apparatus according to the present invention, the improvement comprises a carriage on which there are mounted two pairs of carrier elements aligned along two parallel horizontal axes so as to be able to support a drum resting with its flanges on these carrier elements, means for guiding the carriage, capable of causing it to move in a direction perpendicular to the mentioned axes, and drive means capable of moving the carriage between a disengaged position and a loading or unloading position.

BRIEF DESCRIPTION OF THE DRAWINGS

A preferred embodiment of the invention will now be described in detail with reference to the accompanying drawings, in which:

FIG. 4 is a partial elevation on a larger scale, showing a carriage supporting a drum, and FIG. 5 is a top plan view, likewise on a larger scale, showing how the carriage is constructed.

DETAILED DESCRIPTION OF THE PREFERRED EMBODIMENTS

Figure 1:
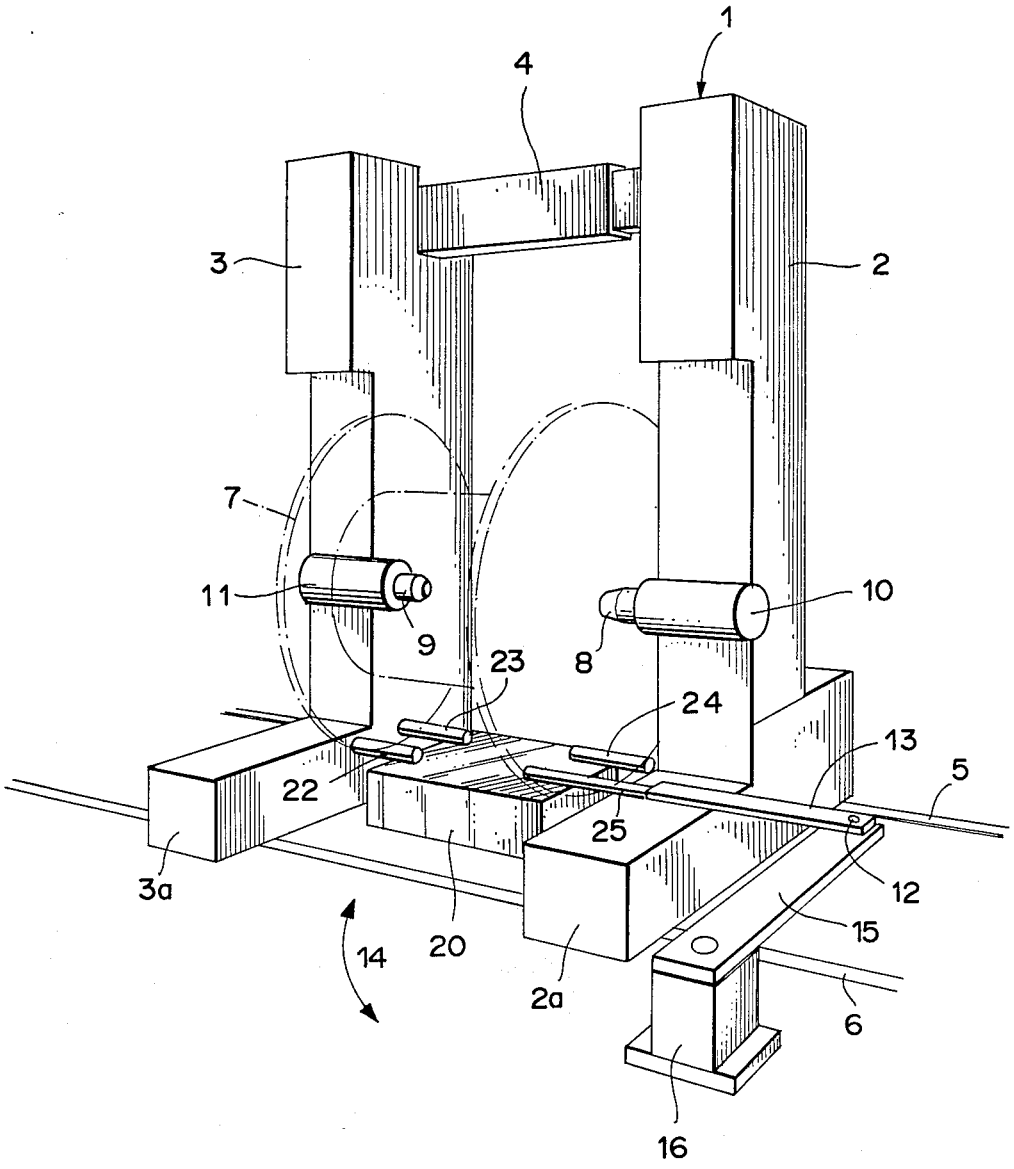
FIG. 1 is a diagrammatic perspective view showing a gantry winding machine and the essential elements of the apparatus according to the invention.

Generally speaking, the embodiment to be described below relates to loading and unloading apparatus having two carriages, although a single-carriage apparatus may also be envisaged. FIG. 1 shows a large-size gantry winding machine 1 comprising two uprights 2 and 3 joined by an upper crosspiece 4. Uprights 2 and 3 slide on parallel rails 5 and 6 so that they can be moved together or apart. A drum 7 is supported on trunnions 8 and 9 mounted in support devices 10 and 11 movable vertically on uprights 2 and 3. The winding machine as a whole rests on a smooth, flat floor in which guide rails 5 and 6 are embedded.

The loading and unloading apparatus proper is designed to use the floor of the factory without the need for any other installations, and especially without the need for installing additional rails. It comprises essentially a carriage 20 joined by a rigid arm 13 to a pivot pin 12. As will be seen below, carriage 20 is supported on rollers. It may be driven by a motor; and because it is connected by arm 13 to pivot pin 12, it will move along an arc as indicated by arrow 14. To facilitate installation, pivot pin 12 takes the form of a fixed trunnion integral with the end of a horizontal flat bar 15 which extends above the floor perpendicular to the direction of rails 5 and 6. Bar 15 is fixed to a base 16. As uprights 2 and 3 are mounted on pedestals 2*a* and 3*a* capable of passing under bar 15, the chosen arrangement does not interfere in any way with the various elements of gantry winding machine 1.

The same elements described above may also be seen in FIG. 2, where carriage 20 bearing drum 7 is in the loading position, so that the recesses provided in the center of each flange of drum 7 are aligned with the axis of trunnions 8 and 9 of drum supports 10 and 11. In this drawing figure, it will be seen that when carriage 20 is in its disengaged or drum-receiving position as shown in dot-dash lines, it is accessible to a fork lifting having prongs sufficiently far apart to pass on either side of carriage 20 in the direction of arrows 17 and 18. On the other hand, as may be seen in FIG. 3, carriage 20 is low enough so that drum 7 can be lifted in order that its flanges may pass over carriage 20.

As stated above, carriage 20 connected to its arm 13 pivoting on trunnion 12 is shown in loading, or engaged, position. However, a second carriage 40, connected to an arm 33 pivoting about a trunnion 32 borne by a flat bar 35 integral with a support 36, is disposed in a location symmetrical to that of carriage 20, so that when the latter is in its disengaged position, shown in the lower right-hand part of FIG. 2, carriage 40 may be brought into loading position after having received a drum brought up by means of a fork lift moving in the direction of arrows 37 and 38.

Figure 3:
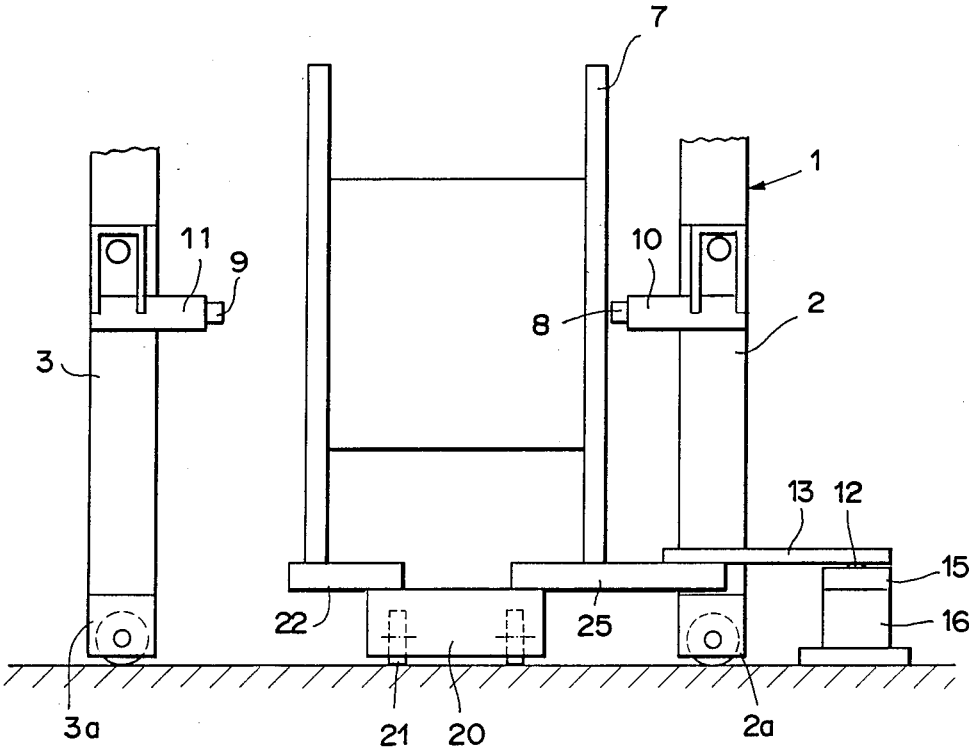
FIG. 3 is an elevation of the apparatus.

FIG. 3 shows diagrammatically how the flanges of drum 7 are supported on carriage 20. The latter comprises four rollers 21, the axles of which are oriented horizontally pointing toward pivot pin 12. Mounted above the chassis of carriage 20 are arms 22, 23, 24, 25, three of which are movable axially so as to adapt to the axial length of the drum to be transported. These arms constitute the carrier elements of carriage 20.

The design of carriage 20 proper is shown in greater detail in FIGS. 4 and 5. The two arms 22 and 23 are symmetrical relative to the longitudinal axis of carriage 20. They are made up of sections of cylindrical tubing which slide in fixed supports 26 and 27 having cylindrical bores fitted to the outside diameter of arms 22 and 23. Guide cylinders 26 and 27 are fixed to the top surface of carriage 20. Support arm 24 includes a shaft 28 guided by a fixed bearing 29. At one end, arm 24 has a widened portion 34 which slides within the bore of arm 23, whereas at the other end shaft 28 includes a cylindrical portion 30 of the same diameter as arm 23, intended to support a flange of the drum 7. Parallel to arm 24, arm 25 is supported at both ends by side plates 31 integral with carriage 20 and with arm 13.

Stop plates 41 and 42 are provided at each end of the arrangement described. Plate 41 connects the ends of the two telescopic arms 22 and 23, while plate 42 is integral with arm 24 and extends at its other end into a notch made in arm 13 between the two side plates 31. Plates 41 and 42 may be used to position the flanges of drum 7. On the other hand, they are connected to an operating mechanism which comprises two threaded rods 43, 44, two fixed nuts 45, 46 mounted on the top surface of carriage 20, and a turnbuckle 47 which connects the two rods 43 and 44 between nuts 45 and 46. Keys integral with rods 43 and 44 slide in a longitudinal inside groove of turnbuckle 47 so that the rotation imparted to the mechanism by a crank 48 first turns rod 43 in nut 45, but likewise, via turnbuckle 47, rod 44 in nut 46. It will be understood that since the threads of rods 43 and 44 are of opposite directions, if crank 48 is turned one way, rods 43 and 44 move away from one another within their respective nuts, whereas if crank 48 is turned the other way, they move toward one another. The result is a mechanism for controlling telescopic arms 22, 23, and 24 which is very simple to construct and very easy to operate. The arrangement of this mechanism is particularly sensible because, as it is mounted on carriage 20, if a jack mechanism were to be used, for instance, it would be necessary to provide for control-fluid feed lines in the form of flexible tubes, which would complicate the installation.

The construction described above is robust and rigid enough for arms 22, 23, 24, and 25 to support a drum by its two parallel flanges. Moreover, it is narrow enough so that a drum carried by its flanges on the two prongs of a fork lift can easily be placed on the carriage when it is in its disengaged or drum-receiving position as shown, for example, in solid lines at the lower left of FIG. 2 or in dot-dash lines at the lower right of the same drawing figure. The apparatus described, of a simple design, is compact and allows the transport paths of the drums to be efficiently organized, e.g., in a cable-manufacturing plant. It facilitates bringing the drums up to and removing them from a winding or unwinding machine installed as either the first or the last machine in a cable-manufacturing line.

Figure 2:
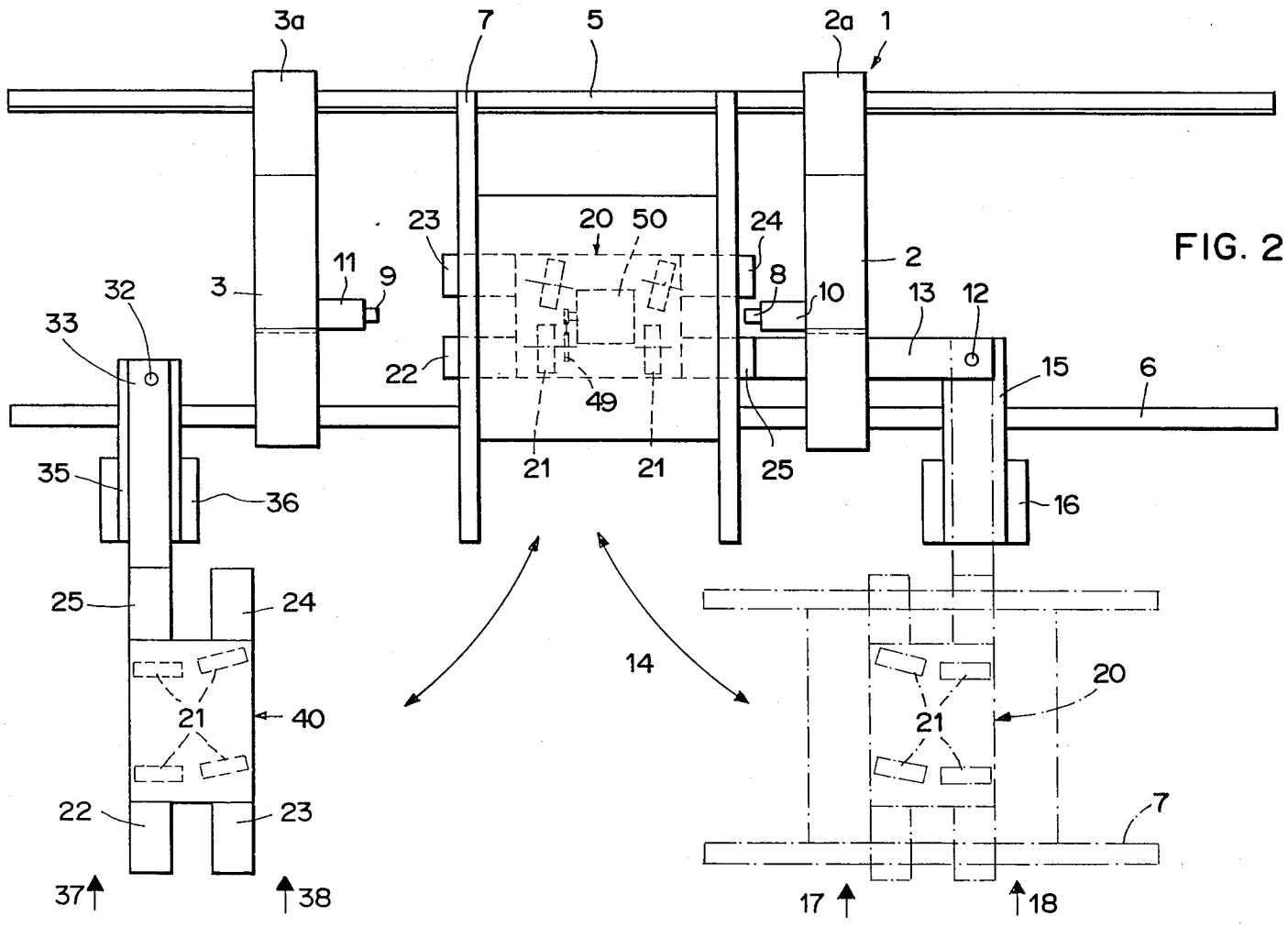
FIG. 2 is a top plan view, also diagrammatic, showing the apparatus completely set up on either side of the gantry winding machine.

In the embodiment illustrated in FIG. 2, carriage 20 comprises its own motor 50 mounted in the base of the carriage. One of the rollers 21 takes the form of a driving roller, i.e., its axle is integral with a pulley or gearwheel 49 connected, either by gearing or by a chain or belt, to the drive shaft of motor 50.

What is claimed is:

1. Apparatus for loading and unloading a drum having two flanges on a winding machine, comprising:

a carriage, two pairs of carrier elements disposed on said carriage and aligned along two parallel horizontal axes for supporting the drum by its flanges, means for moving said carriage in a direction perpendicular to said horizontal axes, said means for moving said carriage comprising:

drive means for moving said carriage along a path between a first, drum-receiving position and a second, drum-loading or -unloading position, and an arm having one end pivoted about a fixed vertical axis and the other end joined to said carriage such that said path is arcuate.

2. The apparatus of claim 1, wherein said arm is integral with said carriage.

3. The apparatus of claim 1 for loading and unloading a drum on a gantry-type winding machine having two uprights, said apparatus comprising two said carriages disposed symmetrically relative to the winding machine, each said fixed vertical axis being situated close to one of said uprights.

4. The apparatus of claim 1, further comprising a plurality of rollers having fixed orientations, said carriage being mounted on said rollers.

5. The apparatus of claim 4 for loading and unloading a drum on a winding machine installed on a floor, said rollers being adapted to roll on said floor and having axles with differing orientations for causing said carriage to move along an arcuate path centered on said fixed vertical axis.

6. The apparatus of claim 1, wherein at least some of said carrier elements are cylindrical parts movable parallel to said horizontal axes for adjusting said carriage to the axial length of the drum.

7. The apparatus of claim 6, further comprising a crank and a control mechanism operated by said crank for moving said cylindrical parts.

* * * * *